United States Patent [19]

Helasuo et al.

[11] Patent Number: 4,625,814

[45] Date of Patent: Dec. 2, 1986

[54] PERCUSSIVE DRILL ROD SYSTEM

[75] Inventors: Kalevi Helasuo; Antero Ala-Jokimäki, both of Vantaa, Finland

[73] Assignee: Oy Airam Ab Kometa, Finland

[21] Appl. No.: 637,222

[22] PCT Filed: Nov. 29, 1983

[86] PCT No.: PCT/FI83/00074

§ 371 Date: Jul. 19, 1984

§ 102(e) Date: Jul. 19, 1984

[87] PCT Pub. No.: WO84/02158

PCT Pub. Date: Jun. 7, 1984

[30] Foreign Application Priority Data

Nov. 30, 1982 [FI] Finland ..... 824126

[51] Int. Cl.[4] ..... E21B 7/00; E21B 17/18

[52] U.S. Cl. ..... 175/57; 175/320

[58] Field of Search ..... 175/57, 65–72, 175/320, 324; 173/78–80

[56] References Cited

U.S. PATENT DOCUMENTS

| | | | |
|---|---|---|---|
| 2,043,504 | 6/1936 | Blow | 175/70 |
| 2,485,098 | 10/1949 | Johnson | 175/324 |
| 3,152,458 | 10/1964 | Simonin | 175/320 X |
| 3,658,368 | 4/1972 | Hokanson | 285/333 |
| 3,730,286 | 5/1973 | Weiner | 175/320 |
| 3,831,753 | 8/1974 | Gaylord | 175/320 X |
| 4,022,285 | 5/1977 | Frank | 175/65 |

FOREIGN PATENT DOCUMENTS

| | | |
|---|---|---|
| 2005909 | 12/1969 | France . |
| 300098 | 4/1968 | Sweden . |
| 336316 | 7/1971 | Sweden . |
| 401232 | 4/1978 | Sweden . |
| 404227 | 9/1978 | Sweden . |
| 1265715 | 3/1972 | United Kingdom . |

*Primary Examiner*—Stuart S. Levy
*Assistant Examiner*—Thomas R. Hannon
*Attorney, Agent, or Firm*—Steinberg & Raskin

[57] ABSTRACT

Method and apparatus for Percussive drilling, in which a drill rod is selected with dimensions such that cross-sectional areas of an inner channel within the rod for flushing medium, and of an outer channel formed between the rod and material being drilled, are substantially equal, so that flow resistance of the drill particles and consumption of flushing powder are reduced.

11 Claims, 14 Drawing Figures

PERCUSSIVE DRILL ROD SYSTEM

BACKGROUND OF THE INVENTION

The subject of the invention is a method employed in long-hole drilling in which a bit which drills a full hole is used and to which percussive energy is transferred through a steel drive rod. The rod is made up of joined extension pieces according to the depth of the hole and which are joined one to another by means of a threading system. The extension piece has an internal thread at one end and on the other end, a corresponding external thread so that the extension pieces externally form a continuous, stepless drill rod. Also in continuation of the drilling rod, there is provision in its axial direction for an internal hole or central flushing channel so that, according to the invention, intermediate pressurized fluid flushing media such as water or air can be brought into the hole to be drilled and with the aid of which the particles are conveyed out of the hole through an annular space or side flushing channel between the outer surface of the drill rod and the wall of the drilled bore. In this method the diameter of the bore to be drilled varies between 30 mm and 300 mm and the drilling machine proper is arranged so as to operate outside the hole to be drilled.

In rock drilling, a pneumatic drill, that is a drill operating on compressed air, is used. In a pneumatic drill, the greater part of the energy is used percussively although a considerable part of it is also consumed by the flushing action. In recent times, hydraulic drilling machines have, however, come onto the market and in these the energy used for percussion is fundamentally less than in pneumatic drilling machines. The development of fully hydraulic drilling machines has made it possible to economically produce high striking efficiency, so that the drilling of larger holes has become possible. Because in the hydraulic drilling machine, relatively less percussive energy is used, the significance of the energy consumed in flushing has become more important. Thus a drawback which has long been experienced in drilling has become emphasized. This drawback is the low efficiency ratio of the flushing system, occurring especially in the drilling of larger holes in excess of 75 mm diameter. When drilling large holes with the drill rods used today an exceptional quantity of flushing air is needed. Thus the situation arises in which the flushing uses even more energy than percussion. This is caused by the fact that with conventional drill rods, it is not possible to achieve sufficient flushing action to correspond with the increased drilling efficiency.

The drill rod has two functions in percussive rock drilling. First, it transfers the striking, rotation and feeding forces from the drilling head to the drilling bit. Secondly, it acts as part of a conveying system that removes the loosened rock material from the drilled hole. This transfer is carried out by a flushing system, which consists of the drill rod flushing hole or central flushing channel, through which the flushing substance is led to the bottom of the drilled hole. The drill bit connected to the lower part of the drill rod directs the flow of the flushing substance to the bottom of the drilled hole so that the hole is cleaned as efficiently as possible. The flushing substance and loosened rock material are led out of the hole through the side flushing channel, which is formed by the space between the hole which has been drilled and the drill rod.

In order that the loosened rock material may be carried away efficiently enough, the flow velocity of the flushing air or water between the hole to be drilled and the drill rod must be sufficiently high. When using air flushing, the velocity should be at least 25 m/s and with water flushing 1 m/s. If the flow rate of the intermediate flushing substance is not high enough, the drill bit has to crush the rock material several times before it is fine enough to be carried out of the hole by the flushing substance. The markedly increased efficiency of hydraulic drilling machines has led to this situation. When the flushing efficiency cannot correspond efficiently enough to the drilling efficiency, it diminishes the penetration force of the drill, thus also dimishing the efficiency of drilling.

Drill rod dimensions are determined in two stages according to an established method. Firstly, the drill rod diameter is determined in order that it can withstand percussive rotational and feeding forces imposed on it by the drilling machine. Secondly the size of the flushing hole is selected. When that portion of the area of the hole to be drilled has been allocated to the drill rod, sufficient for the mechanical forces it must transmit, the rest is to be used as efficiently as possible for removal of the loosened rock material from the hole.

The size of the flushing hole in the drill rod is normally 7–15% of the area derived from the outside diameter of the rod. A larger flushing hole is particularly needed in downwardly-fed long-hole drilling.

The optimum design dimensions for a flushing system should meet the two following conditions. Sufficient flow velocity of the flushing substance should be attainable in the side wall channel with the least possible pressure and flushing medium quantity, that is with the corresponding least possible energy consumption. The side flushing channel must also be sufficiently large so that the loosened rock material can pass through even when drilling with a worn drill bit. The first of the conditions is fulfilled when the flow resistance of the flushing system is at a minimum. For fulfillment of the second condition, the difference between the drill rod must be at least 10–15 mm. Then, even the largest loosened rock fragments are removed without impediment from the hole.

Since the size of the flushing hole in a drill rod (the central flushing duct) in accordance with modern practice is normally 7–15% of the rod area given by its outside diameter, the proportion of the surface area of the hole to be drilled corresponding to the central flushing hole is only 2–7%. In drilling the rather larger holes, the portion between the drill rod and the hole to be drilled, that is the flushing channel cross-sectional area, is many times greater in comparison with that of the central flushing duct. This means that with the commonly used conventional drill rod, the central flushing duct constitutes a throttling section in the flushing system which is an ample source of energy consumption, and through which it is not possible to lead a sufficient quantity of flushing substance. When on the other hand, the side flushing channel is large in comparison with the central flushing duct, the flow rate of flushing substance in the side flushing channel cannot be made sufficiently high to lift the loosened rock particles out of the drilled hole.

SUMMARY OF THE INVENTION

The object of this invention is to eradicate the previously mentioned drawbacks and to achieve a method whereby dimensions can be allocated to the drill rods, in accordance with saving flushing energy and more efficient flushing. The method according to the invention is characterized in that the cross-sectional area of the steel drill rod is selected in accordance with the power of the drilling machine used within the defined limits of the diameter of the hole to be drilled and the external diameter of the tubelike drill rod and its internal bore, that is the diameter of the central flushing channel, so that the internal bore cross-sectional area is fundamentally equally as large as the annular space between the drill rod outer surface and the wall of the hole to be drilled. Flow resistance of the medium intended for flushing the drilled particles through the side flushing channel section and the energy consumed by the flushing action are thereby reduced.

An object of the invention is also the performance of previously presented method when a percussion drill rod system is to be used, in which the drill rod is composed of extension pieces in which there is an internal thread in one end and a corresponding external thread at the other end. The drill rod system according to the invention is characterized in that the drill rod is tubular and that it is made of such steel tube that the relationship of the inner diameter to that of the external diameter is of the order 0.7 . . . 0.9, and that at each end of the aforementioned steel tube, there are parts which have been fastened into position by means of welded joints and onto which threads have been machined, at one end an internally threaded part and at the other end the corresponding external thread.

A further object of the invention is a threaded system to be used for the performance of the previously presented method as a means of joining the extension components of the precussion drill rod to one another. The threaded system according to the invention is characterized in that the pitch angle and form depth of the threads of the screwed portions of the tubular extension pieces are substantially constant, irrespective of the tube outside diameter, so that the thread pitch and number of starts of threads increase in accordance with the increase in diameter of the tube. The thread system in accordance with the invention makes it possible for the thread to be as shallow as possible for each tube diameter value. Thus, the diameters of the central flushing channel do not fundamentally lessen at the threaded section, as occurs with conventional drill rods.

BRIEF DESCRIPTION OF THE DRAWINGS

The invention is described in the following examples by the aid of reference to the attached drawings, in which.

DESCRIPTION OF THE PREFERRED EMBODIMENTS

Figure 1:
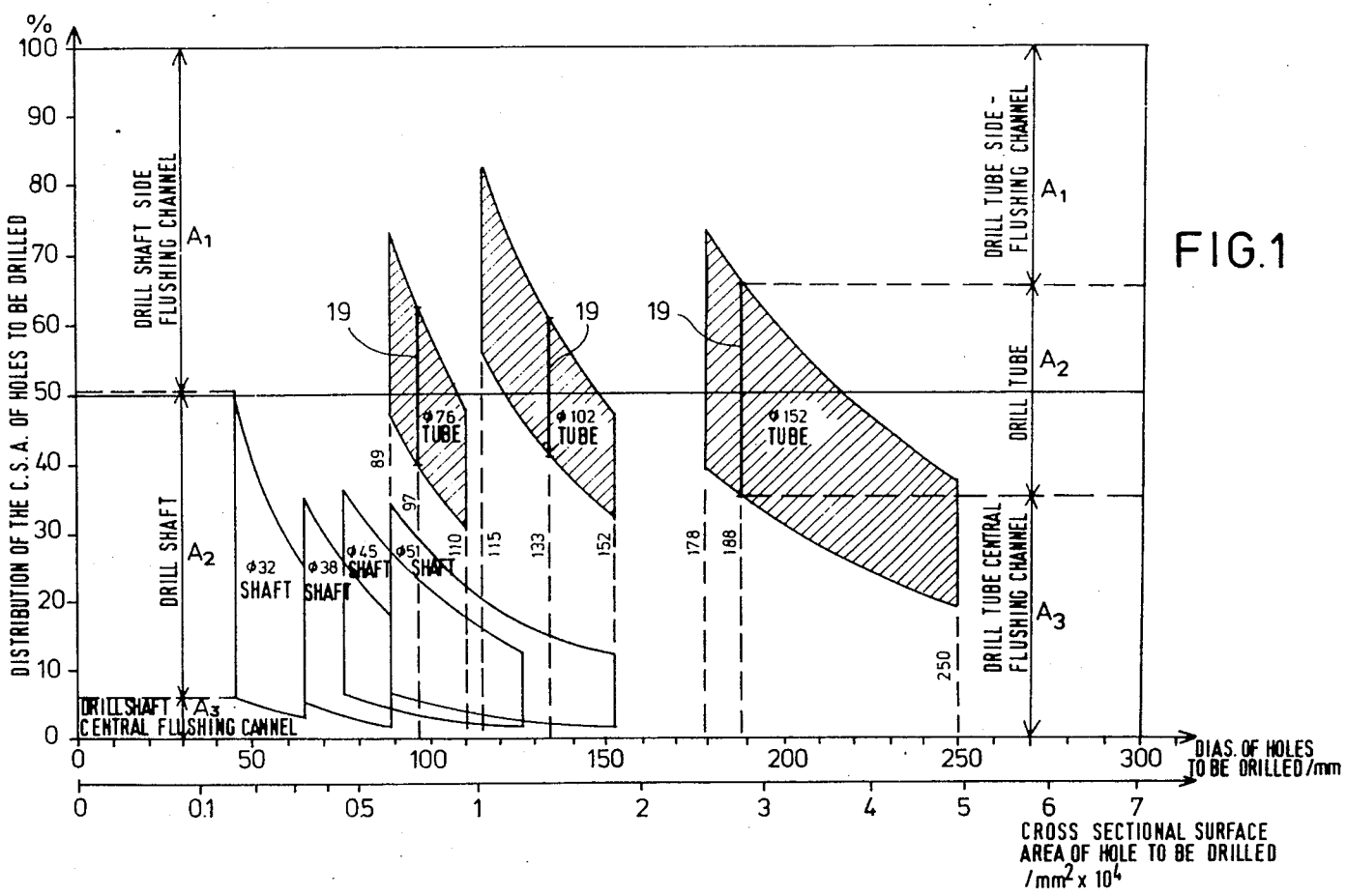
FIG. 1 depicts the distribution of the cross-sectional area of the hole to be drilled when drilling with conventional drill rods and in drilling with the tubular drill rod in accordance with the invention.

The distribution of cross-sectional area of the holes to be drilled is drawn up in FIG. 1 in drilling with four conventional drill rods and three tubular drill rods in accordance with the invention. From this diagram, it may be seen that in drilling with conventional drill rods the proportion of the side flushing channel is many times larger than that of the central flushing channel. This design does not constitute an economic solution to flushing. Instead, in drilling with the three tubular drill rods in accordance with the invention, the side flushing channel and central flushing channel are fundamentally of the same order of size. In practice there cannot be an individual rod for every size of hole to be drilled, so that these three selected tube sizes cover the necessary range sufficiently well. Each optimum drill rod section in which the central flushing channel and side flushing channel are precisely of the same size, can be seen on the diagram at reference number 19.

In accordance with the present invention, the external diameters ($D_2$) of the drill rods 2 may be selected as follows:

76 mm, 102 mm, 152 mm, with the diameter ($D_3$) of the internal holes 7 being correspondingly about 60 mm, 85 mm, and 110 mm. When the drill rod has a diameter of 76 mm, holes 8 are drilled with diameters ($D_1$) of 89–110 mm; when the drill rod has a diameter of 102 mm, holes 8 are drilled with a diameter of 115–152 mm; and when the drill rod has a diameter of 152 mm, holes 8 are drilled of diameter 178–250 mm.

Figure 2:
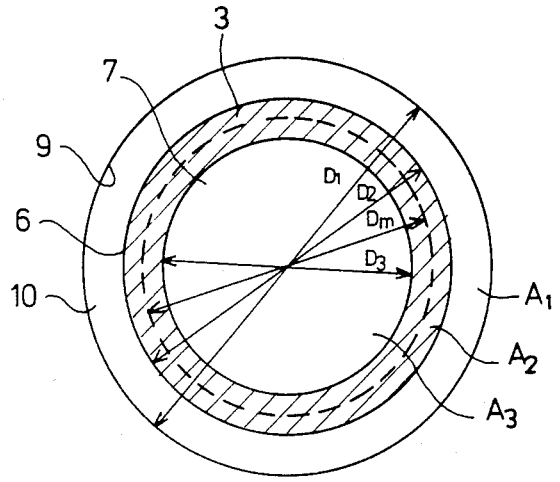
FIG. 2 depicts the cross-section of the hole to be drilled in accordance with the invention when drilling with a tubular drill rod.

The cross-section of the hole 8 to be drilled is shown in FIG. 2. The circle represented by the broken line, the diameter of which is $D_m$, represents the limiting line, at which the internal and external surface areas are of identical magnitude. It also corresponds to the 50% line shown in FIG. 1. If the drill tube could be infinitely thin-walled, then the broken line would represent the drill tube. In practice the tubular drill rod diameter exceeds the broken line shown in FIG. 2 in both directions. In the circumstances of this example, the surface area of the drawn drill rod 3 is 30% that of the hole 8 to be drilled.

The cross-sectional area ($A_3$) of the internal duct or central flushing channel 7 of the drill rod 2 is preferably 0.6–1.4, more preferably 0.9–1.1 times the cross-sectional area ($A_1$) of the annular space or side flushing channel 10 between the outer surface 6 of the drill rod and the wall 9 of the hole 8 to be drilled. Drilling machine size is selected so that penetration speed, i.e. drilling speed of the drill bit 1, is essentially constant for different sizes of the hole 8 to be drilled.

Figure 3:
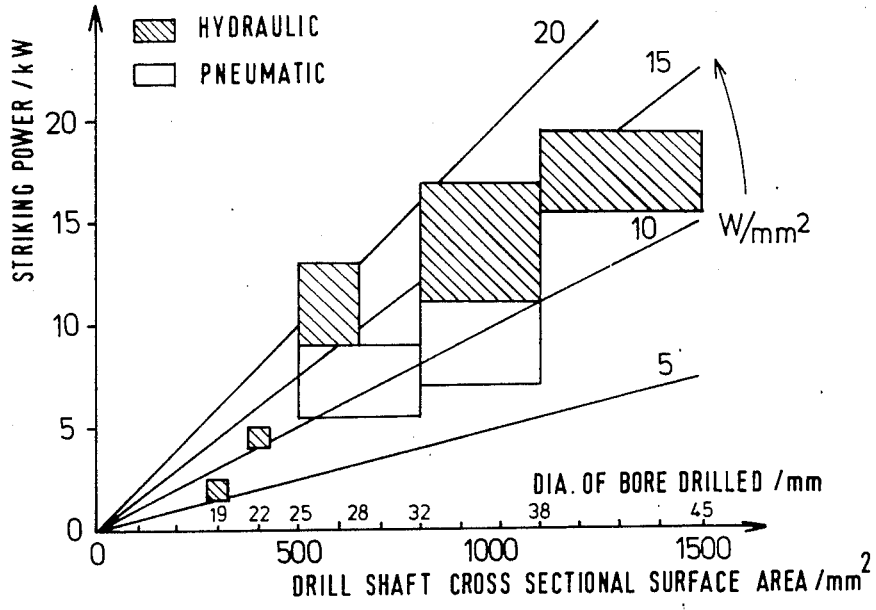
FIG. 3 illustrates several examples of the relationship between percussive power and drill rod in using hydraulic and pneumatic drilling machines.

In FIG. 3, the striking power to be attained with various drill rods, calculated on the basis of the surface area of the drill rod cross-section, is shown. From the figure it can be observed that these values are greater with a hydraulic drilling machine than with a pneumatic machine.

Figure 4:
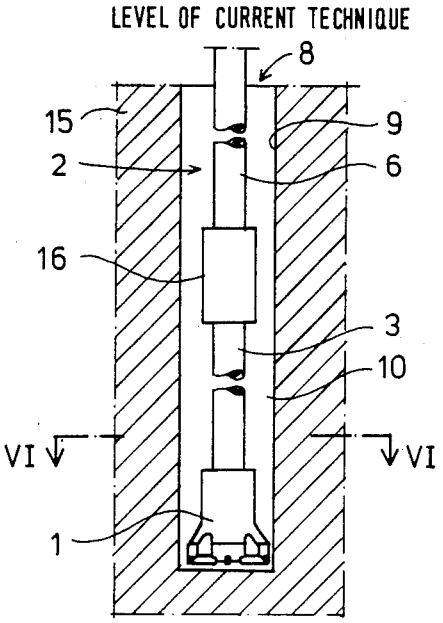
FIG. 4 illustrates in simplified form, drilling of a hole with a conventional drill rod.
Figure 7:
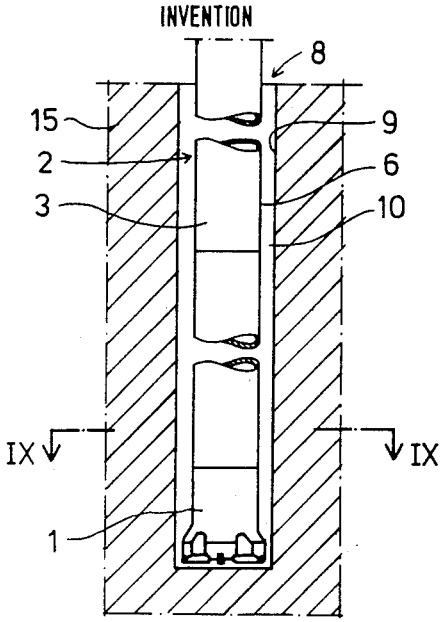

In FIGS. 4 and 7 conventional drill rod constructions are compared in accordance with the invention. The conventionally used central flushing channel is also narrow. The channel 10 remaining between the drill rod 3 and the wall 9 of drilled hole 8 is instead remarkably large. The drill rod 3 constructed in accordance with the invention shown in FIG. 7 is tubular in form and noticeably greater in diameter than the conventional drill rod. In consequence the central flushing channel can be made to correspond to the cross-sectional area of channel 10 left between the cross-sectional area dependent on drill rod 3 and the hole wall 9. In order that flow speed may be optimal in the side flushing channel, the entire length of the assembled rod part is smooth on the external surface. The material needed in the region of the connections is located inside the tube at the central flushing channel.

Figure 5:
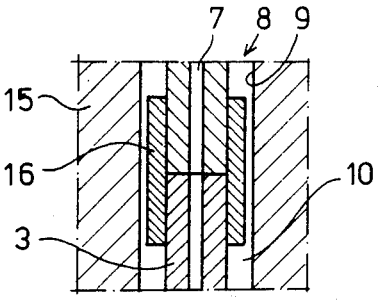
FIG. 5 illustrates a vertical section of the extension of the drill rod in the area shown in FIG. 4.
Figure 8:
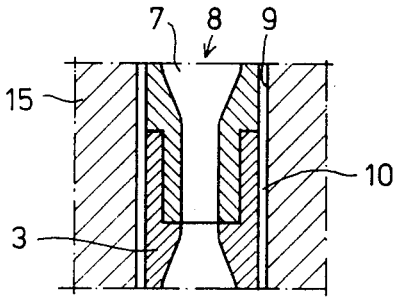

Drill rod connections in accordance with the invention and those of conventional type are shown in vertical cross section in FIGS. 5 and 8. In the conventional construction shown in FIG. 5, the connection of rod 3 is composed of an external removable sleeve 16. This type of connection is however awkward in practical circumstances because positioning of the removable sleeve onto the correct section of the joint is uncertain. Further, the sleeve can loosen pieces of rock from the wall 9 of the bore 8, as often happens when drilling broken rocks. Withdrawal of the drill rod from the hole is then awkward. Instead of this, FIG. 8 depicts the drill rod connection according to the invention, the diameter of which is the same as that of the drill rod proper 3. The drill rod is then of the same thickness and smooth in all sections. The internal central flushing channel 7 of the rod and the side flushing channel 10 outside it are in cross section fundamentally of equal size.

Figure 6:
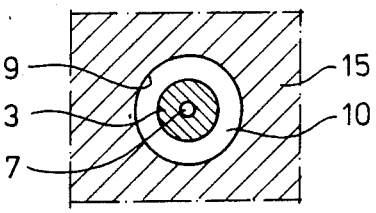
FIG. 6 depicts the sectional view as taken along line VI—VI in FIG. 4, FIG. 7 corresponds to FIG. 4 and shows the drill rod according to the invention, FIG. 8 corresponds to FIG. 5 and shows in vertical section the drill rod extension section of FIG. 4.
Figure 9:
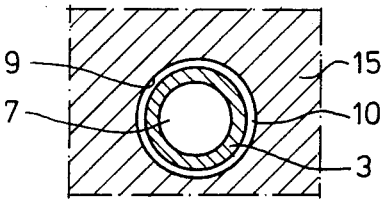
FIG. 9 shows a section taken along the line IX—IX in FIG. 7.

From the cross section of the conventional drill rod shown in FIG. 6, the small size of the central duct 7 inside rod 3 can be seen. In the construction shown in FIG. 9 in accordance with the invention, the central flushing chamber 7 is essentially larger. In the construction according to the invention there are no removable sleeves so that the extension of the drill rod can be performed simply by fitting the extension pieces one upon another.

Figure 10:
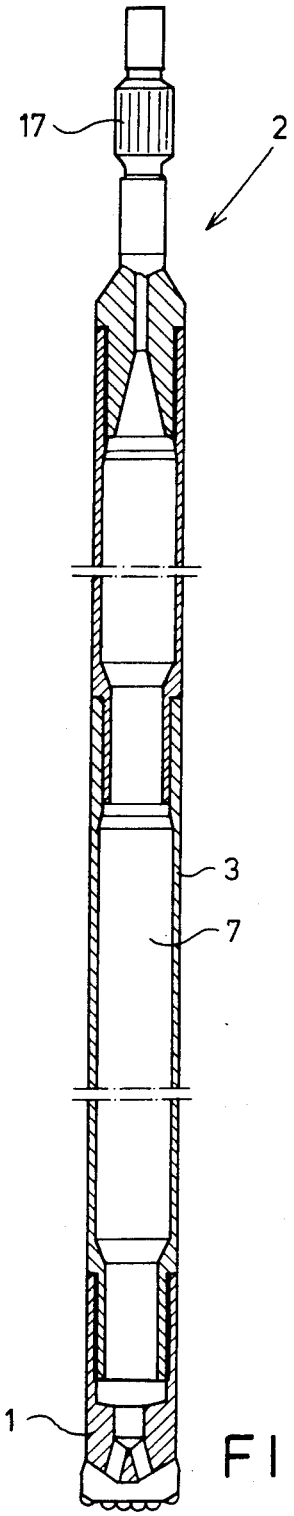
FIG. 10 illustrates a vertical section of the drill rod in accordance with the invention.
Figure 11:
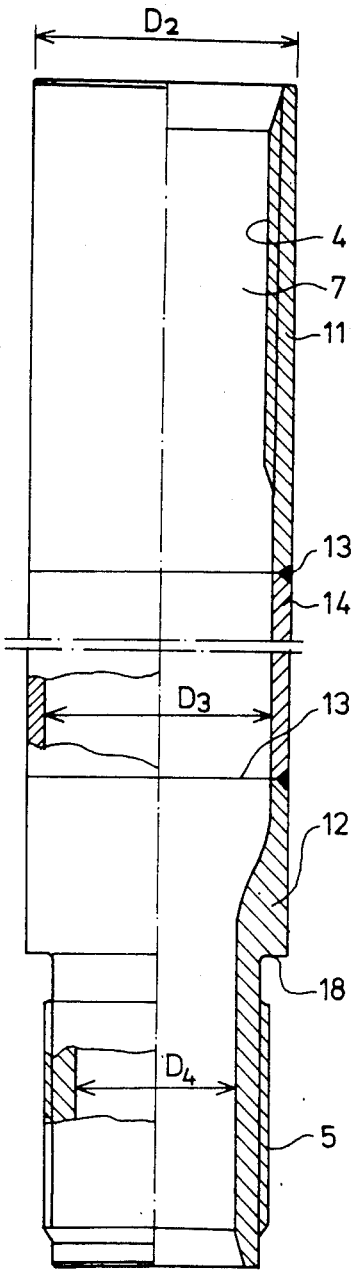
FIG. 11 depicts an enlarged partial section of the extension sleeve of the drill rod shown in FIG. 10.

The drill rod 2 of FIG. 10 comprises the fastening connection 17 to the drilling machines, several drill rod extension pieces 3, and the drill bit 1. All these components are joined to one another by threads which are so formed that the outer diameter of the drill rod is the same size over almost all its length. The central flushing channel 7 in the tubular construction is noticeably larger. The drill rod extension rod can be seen in FIG. 11 enlargened and partially in section. It is made up of the steel tube 14, at both ends of which threaded parts 11 and 12 are connected by welded joints 13 which are preferably friction-weld joints. The upper end of the tube 14 is connected by means of internal screwed threads 4 of female threaded part 11 and correspondingly at the bottom end by the externally furnished threads 5 of the male threaded part 12. The outer surface of the tube is smooth and forms with its threaded parts connected, an integral straight cylindrical surface. The inner part of the drill rod instead forms in the area of the threaded parts 11 and 12, thicker walls. The central chamber 7 naturally then narrows slightly at these places but however remains sufficiently large.

The inside diameter ($D_4$) of the threaded component 12 of the extension piece 3 furnished with external threads 5, is, at the threaded section thereof, 0.4 to 0.7 times the diameter ($D_2$) of the drill rod tube 14. A shoulder 18 is formed in the region of threads 4, 5 of extension piece 3, which abuts a corresponding shoulder of another extension piece when the extension pieces are being joined together.

Figure 12:
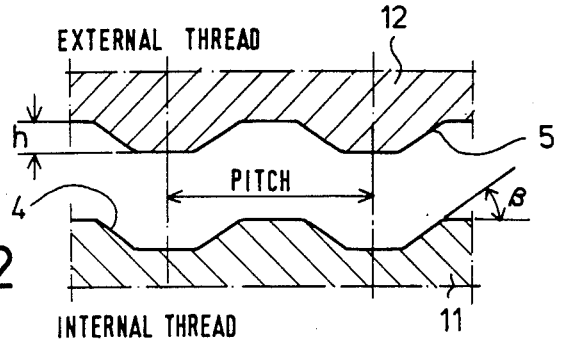
FIG. 12 illustrates in section an enlarged view of the drill rod thread connections in accordance with the invention, FIG. 13 corresponds to FIG. 12 and illustrates other modes of application.
Figure 13:
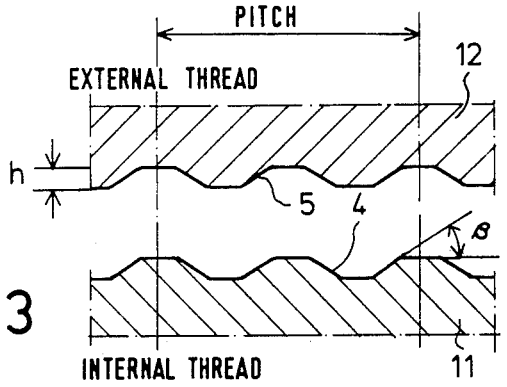

In FIGS. 12 and 13, two different threads are presented which are used in accordance with the invention to connect the drill rods together. In FIG. 12, is shown a single start thread which is used with drill rods of smaller diameter. In larger drill rods, for example with a diameter in excess of 70 mm, a two-start thread is used as shown in FIG. 13. In the largest drill shafts of all, as for example in excess of 152 mm diameter one may even use three-start threads. The height of the thread form is near to a constant in each thread. With maximum advantage this is 2–3 mm.

When the tube outside diameter ($D_2$) is less than 70 mm, the thread is a single-start thread and the pitch is less than 23 mm. When the tube outside diameter is 70–152 mm, the thread is a double-start thread and its pitch is 23–45 mm; and when the tube diameter is greater than 152 mm, the thread is a triple-start thread and its pitch is greater than 45 mm.

Figure 14:
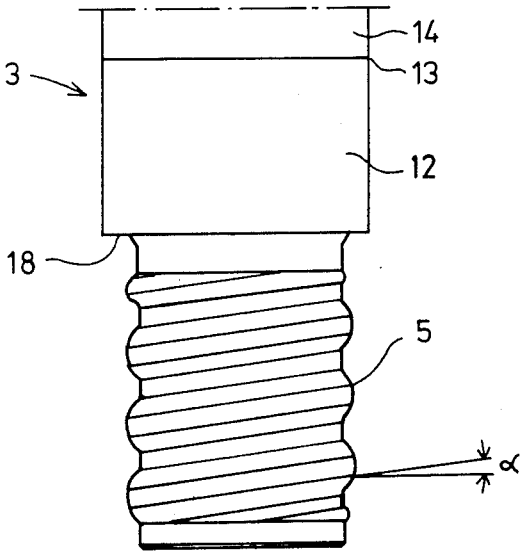
FIG. 14 illustrates the external thread of the drill rod in accordance with the invention, as seen from the side.

The helix angle $\alpha$ of the thread 5 in FIG. 14 is 6°–8°, preferably about 7°. This angle is mainly a constant in all the drill tubes according to the invention, even though the number of starts changes. The helix angle $\alpha$ and the thread height (h) are essentially constant and independent of the outside diameter ($D_2$) of the tube, so that the thread pitch and number of thread starts (n) increase with increasing diameter ($D_2$) of the tube. The thread height is 1.5 to 4 mm, preferably 2–3 mm. The flank angle $\beta$ of the threads is 25°–45°, preferably about 35°.

An optimum flushing solution is achieved in the method according to the invention in which cross-sectional areas of the central and side flushing channels are essentially identical. The flow resistance and power consumption caused by flushing are then at a minimum. The efficiency of flushing is also fundamentally increased because the drill rod outer surface is straight and smooth, optimal flow of the flushing medium and exited rock material then occurs. There is also a guiding effect with the drill rod according to the invention and for this reason the straightness of holes to be drilled is better than normal. The power range of the aforementioned drilling machine and also the aforementioned cross-sectional area ($A_2$) of the drill rod 2 are selected such that the percussive energy transmitted by the drill rod per cross-sectional surface area unit is in the range of 5–20 W/mm$^2$, preferably about 10 W/mm$^2$.

In the method according to the invention, the optimum solution is thus attained when the drill rod diameter is selected in accordance with the size of the hole or bore to be drilled and not according to the drilling machine used. In practice, this is possible because of the fact that only a few sizes of holes can be drilled with machines of normally recognized power rating classes. To the technical person, it is clear that the various modes of application of the invention can be modified within the framework of the present invention.

We claim:

1. A percussive drill rod arrangement for long-hole rock drilling of a hole having a diameter of about 30 mm. to about 300 mm., said arrangement comprising a full-hole drilling bit, a drill rod connected to said drilling bit and through which percussive energy is transferred to said drilling bit, said rod being formed by at least one extension piece which is adapted to be threadingly connected to another extension piece, said extension piece comprising an internally threaded component, a tubular component, an externally threaded component, weld joints connecting said internally threaded component with said tubular component, and said externally threaded component with said tubular component, an outer surface of said drill rod being substantially continuous and stepless, and an inner channel axially extending through said extension piece for supply of pressurized flushing medium such as water or air into the hole being drilled for conveying away drilled material through an annular space or side flushing channel formed between said drill rod and a wall of the hole being drilled, a ratio of a diameter of said inner channel to an outer diameter of said tubular component being from about 0.7 to 0.9.

2. The arrangement of claim 1, wherein said weld joints are friction weld joints.

3. The arrangement of claim 1, wherein a ratio of the diameter of said inner channel at said externally threaded component to the outer diameter of said tubular component is from about 0.4 to 0.7.

4. The arrangement of claim 1, wherein said externally threaded component additionally comprises a shoulder, such that said shoulder abuts an adjacent end of an internally threaded component when said externally threaded component and the adjacent internally threaded component are screwed together, whereby said outer surface of said rod is substantially continuous and stepless.

5. The arrangement of claim 1, wherein threads of said threaded component have a helix angle and a height which are each substantially constant and independent of the external diameter of said tubular component, such that the number of thread starts and thread pitch increase with increase in the external diameter of said tubular component.

6. The arrangement of claim 5, wherein when the external diameter of said tubular component is less than about 70 mm, the threads are single-start threads and thread pitch is less than about 23 mm, when the external diameter of said tubular component is from 70 to 155 mm, the threads are double-start threads and the thread pitch is 23 to 45 mm, and when the external diameter of said tubular component is greater than about 152 mm, the threads are triple-start threads and the thread pitch is greater than about 45 mm.

7. The arrangement of claim 6, wherein the helix angle of the thread is about 7°, and the thread height is from 2 to 3 mm.

8. The arrangement of claim 5, wherein the helix angle of the threads is from 6° to 8°, and thread height is from 1.5 to 4 mm.

9. The arrangement of claim 8, wherein the thread height is from 2 to 3 mm.

10. The arrangement of claim 5, wherein a flank angle of the threads is from 25° to 45°.

11. The arrangement of claim 10, wherein the flank is about 35°.

* * * * *